US011992067B2

(12) United States Patent
Snyder

(10) Patent No.: US 11,992,067 B2
(45) Date of Patent: May 28, 2024

(54) SUPPORTIVE BRA

(71) Applicant: MJ's Atomic Designs, LLC, Fremont, CA (US)

(72) Inventor: Mary Jane Snyder, Fremont, CA (US)

(73) Assignee: MJ's Atomic Designs, LLC

( * ) Notice: Subject to any disclaimer, the term of this patent is extended or adjusted under 35 U.S.C. 154(b) by 44 days.

(21) Appl. No.: 16/993,997

(22) Filed: Aug. 14, 2020

(65) Prior Publication Data

US 2021/0052020 A1 Feb. 25, 2021

Related U.S. Application Data

(60) Provisional application No. 62/888,790, filed on Aug. 19, 2019.

(51) Int. Cl.
*A41C 3/00* (2006.01)
*A41C 3/12* (2006.01)

(52) U.S. Cl.
CPC ..... *A41C 3/0021* (2013.01); *A41C 3/0014* (2013.01); *A41C 3/122* (2013.01)

(58) Field of Classification Search
CPC ..... A41C 3/06
See application file for complete search history.

(56) References Cited

U.S. PATENT DOCUMENTS 1,420,248 A * 6/1922 Fay ..... A41C 3/06 450/93
1,899,761 A * 2/1933 Kops ..... A41C 1/06 450/8
2,023,701 A * 12/1935 Rosenfeld ..... A41C 1/08 450/155
2,074,796 A * 3/1937 Mason, Jr. ..... A41C 3/00 D2/708
2,253,902 A * 8/1941 Gordon ..... A41C 3/08 450/30
2,352,367 A * 6/1944 Bujdossy ..... A41C 3/00 450/84
2,424,453 A * 7/1947 Glick ..... A41C 3/00 450/1
2,432,910 A * 12/1947 Licht ..... A41C 3/122 450/52
2,438,062 A * 3/1948 Licht ..... A41C 3/08 450/52
2,440,795 A * 5/1948 Clark ..... A41C 3/00 450/92
2,443,127 A * 6/1948 Abeles ..... A41C 3/06 D2/706

(Continued)

FOREIGN PATENT DOCUMENTS

AU 2021107364 A4 * 12/2021
CN 101574169 A * 11/2009

(Continued)

OTHER PUBLICATIONS

U.S. Appl. No. 10/201,192, filed Feb. 12, 2019, Lott.
PCT Search Report and Written Opinion For PCT/US20/046430.

*Primary Examiner* — Jocelyn Bravo
(74) *Attorney, Agent, or Firm* — Remenick PLLC

(57) ABSTRACT

A supportive bra comprises two cups, each adapted to shape, lift, and support a breast, and a chest strap coupled to the two cup. Each cup has a plurality of darts sewn therein.

12 Claims, 5 Drawing Sheets

(56) References Cited

U.S. PATENT DOCUMENTS 2,446,437 A * 8/1948 Schoebel ..... A41C 3/124 450/47
2,455,788 A * 12/1948 Lo Cascio ..... A41C 3/00 450/72
2,460,715 A * 2/1949 Schoebel ..... A41C 3/00 D2/709
2,478,103 A * 8/1949 Hunau ..... A41C 3/0021 450/59
2,497,934 A * 2/1950 Everitt ..... A41C 3/00 D2/709
2,510,012 A * 5/1950 Edelman ..... A41C 3/0007 450/52
2,516,749 A * 7/1950 Brady ..... A41C 3/00 D2/709
2,638,595 A * 5/1953 Goebel ..... A41C 3/00 450/85
2,676,320 A * 4/1954 Sutter ..... A41C 3/00 450/72
2,683,879 A * 7/1954 Dollarhide ..... A41C 3/0028 D2/709
2,689,956 A * 9/1954 Masstab ..... A41C 3/00 450/66
2,709,811 A * 6/1955 Cotsakis ..... A41C 3/06 D2/706
2,711,535 A * 6/1955 Cooney ..... A41C 3/00 450/86
2,959,173 A * 11/1960 Douthit ..... A41C 3/144 450/156
2,976,870 A * 3/1961 Verreault ..... A41C 3/00 450/86
3,225,768 A * 12/1965 Galitzki ..... B29C 51/145 450/39
3,338,242 A * 8/1967 Gernreich ..... A41C 3/00 D2/707
3,467,105 A * 9/1969 White ..... A41C 3/00 450/86
3,779,250 A * 12/1973 Radomski ..... A41C 3/00 450/74
4,174,717 A * 11/1979 Schreiber ..... A41C 3/0057 450/86
D259,370 S 6/1981 Schreiber et al.
D260,445 S 9/1981 Schreiber et al.
4,311,150 A * 1/1982 Schreiber ..... A41C 3/0057 450/86
4,449,533 A * 5/1984 DiTullio ..... A41C 3/00 D2/708
4,458,684 A * 7/1984 Frankel ..... A41C 3/00 450/53
4,470,419 A * 9/1984 DiTullio ..... A41C 3/00 450/19
4,699,144 A * 10/1987 Sherwood ..... A41C 3/148 450/54
5,037,348 A * 8/1991 Farino ..... A41C 3/148 450/82
5,385,502 A * 1/1995 Moretz ..... A41C 3/04 450/32
5,643,043 A * 7/1997 Pflum ..... A41C 3/0057 450/86
5,897,422 A * 4/1999 McGee ..... A41C 3/00 450/58
6,083,080 A 7/2000 Lawson et al.
6,110,005 A * 8/2000 Stephenson ..... A41C 3/10 450/39
6,179,687 B1 * 1/2001 Lee ..... A41F 15/002 450/88
6,306,006 B1 * 10/2001 Cheng ..... A41C 3/10 450/57
6,811,462 B1 * 11/2004 Kenneally ..... A41C 3/08 450/30
6,824,445 B2 * 11/2004 Oneyear ..... A41C 3/02 450/39
7,458,877 B2 * 12/2008 Yu ..... A41C 5/005 450/39
7,922,682 B2 4/2011 Bell et al.
8,038,505 B2 * 10/2011 Huang ..... A41C 5/00 450/39
8,506,348 B2 * 8/2013 Hu ..... A41C 3/144 450/39
8,641,475 B1 * 2/2014 Hung-Ming ..... A41C 3/10 450/38
8,702,469 B2 * 4/2014 Hurd ..... B32B 5/026 450/74
10,201,192 B1 * 2/2019 Lott ..... A41C 3/02
10,342,269 B1 * 7/2019 Rutkoski ..... A41C 3/0057
10,485,270 B2 * 11/2019 Wesley ..... A41C 3/12
2002/0031978 A1 3/2002 Heroff
2003/0211810 A1 * 11/2003 Raimondo ..... A41C 3/04 450/36
2003/0217407 A1 * 11/2003 Andrews-Jones ..... A41B 9/001 2/400
2004/0014394 A1 * 1/2004 Mitchell ..... A41C 5/00 450/65
2004/0224603 A1 * 11/2004 Kaye ..... A41C 3/10 450/1
2005/0075048 A1 * 4/2005 Legaspi ..... A41C 3/10 450/41
2005/0255789 A1 * 11/2005 Gaudet ..... A41C 3/0085 450/41
2006/0025039 A1 * 2/2006 Barbour ..... A41D 15/005 450/1
2006/0079153 A1 * 4/2006 Davidson ..... A41C 3/02 450/58
2006/0160468 A1 * 7/2006 Chen ..... A41C 3/146 450/57
2006/0240743 A1 * 10/2006 Mitchell ..... A41C 5/00 450/1
2006/0252346 A1 * 11/2006 Reinisch ..... A41C 3/0028 450/86
2007/0026767 A1 * 2/2007 Scheininger ..... A41C 3/0028 450/39
2007/0190896 A1 * 8/2007 Yu ..... A41C 5/005 450/39
2008/0268748 A1 * 10/2008 Huang ..... A41C 3/0014 450/39
2009/0098803 A1 * 4/2009 Reinisch ..... A41C 3/0014 450/86
2009/0117824 A1 * 5/2009 Jian ..... A41C 3/10 450/38
2009/0130953 A1 * 5/2009 Gransberry ..... A41C 3/144 450/39
2010/0015886 A1 * 1/2010 Waitz ..... A41C 3/10 450/86
2010/0015887 A1 * 1/2010 Huang ..... A41C 3/144 450/57
2010/0180358 A1 * 7/2010 Drummond ..... A41D 7/00 2/244
2012/0045966 A1 * 2/2012 Zhang ..... A41C 3/144 450/92
2012/0094575 A1 * 4/2012 Sokolowski ..... A41C 5/005 450/92
2012/0149277 A1 * 6/2012 Moses-Jones ..... A41C 3/0028 450/75
2013/0078889 A1 * 3/2013 Pezzner ..... A41C 3/0078 450/1
2013/0205464 A1 * 8/2013 Gibbard ..... A41C 3/0021 450/86
2013/0225045 A1 * 8/2013 Dandapure ..... A41C 5/005 450/39
2013/0237124 A1 * 9/2013 Hall ..... A41C 3/00 450/38
2013/0316615 A1 * 11/2013 Hurd ..... A41D 31/125 264/45.3
2014/0087624 A1 * 3/2014 Yuasa ..... A41C 3/12 450/1
2014/0230119 A1 * 8/2014 Smith ..... A41C 3/0014 450/74

(56) References Cited

U.S. PATENT DOCUMENTS

2014/0256221 A1* 9/2014 Liang ..... A41C 5/005 450/1
2014/0295734 A1* 10/2014 Shashy ..... A41C 3/0057 450/58
2015/0044943 A1* 2/2015 Marshall ..... A41C 3/005 2/69
2015/0056890 A1* 2/2015 Black ..... A41C 3/146 450/86
2016/0150833 A1* 6/2016 Spicer ..... A41C 3/0028 450/82
2017/0119064 A1* 5/2017 Pulliam ..... A41C 3/06
2017/0215491 A1* 8/2017 Yuasa ..... A41C 3/144
2018/0184726 A1* 7/2018 Wesley ..... A41C 3/12
2018/0220718 A1* 8/2018 Wade ..... A41B 1/08
2018/0317571 A1* 11/2018 Caden ..... B32B 5/026
2019/0029334 A1* 1/2019 Wolff ..... A41C 3/0028
2019/0133210 A1* 5/2019 Wade ..... A41D 1/22
2019/0261698 A1* 8/2019 Akerson ..... A41C 3/005
2019/0261699 A1* 8/2019 Rushton ..... A41C 3/0028
2019/0274370 A1* 9/2019 Zhu ..... B32B 7/02
2020/0022421 A1* 1/2020 Kilbey ..... A41C 3/0064
2020/0054079 A1* 2/2020 Rutkoski ..... A41C 3/0028
2020/0113250 A1* 4/2020 Waldman ..... A41C 3/0092
2020/0120999 A1* 4/2020 Mason ..... A41D 31/18
2020/0397068 A1* 12/2020 Cheng ..... A41C 3/005
2020/0404982 A1* 12/2020 Letulle ..... A41C 3/02
2021/0112885 A1* 4/2021 Hunt ..... A41C 3/04
2021/0169152 A1* 6/2021 Choudhury ..... A41F 15/002
2021/0186126 A1* 6/2021 Horsell ..... A41C 3/0057
2021/0315284 A1* 10/2021 Kasvikis ..... A41C 3/0028

FOREIGN PATENT DOCUMENTS

CN 110338477 A * 10/2019 ..... A41C 3/10
WO WO-2011002009 A1 * 1/2011 ..... A41C 3/10

* cited by examiner

SUPPORTIVE BRA

REFERENCE TO RELATED APPLICATIONS

This application claims priority to U.S. Provisional Application No. 62/888,790, filed Aug. 19, 2019, entitled "SUPPORTIVE BRA," and hereby specifically and entirely incorporated by reference.

BACKGROUND

1. Field of the Invention

This invention is directed to a supportive bra and methods for making the supportive bra. Specifically, the invention is directed to a supportive bra that does not have an underwire or use compression to support the breasts and methods for making such a bra.

2. Description of the Background

About 50 percent of women report some pain or discomfort in their breasts during exercise. The level of pain or discomfort typically increases with breast size. A sports bra is a bra that provides support to female breasts during physical exercise. Sturdier than typical bras, they minimize breast movement, alleviate discomfort, and reduce potential damage to chest ligaments. Many women wear sports bras to reduce pain, and physical discomfort caused by breast movement during exercise. Some sports bras are designed to be worn as outerwear during exercise such as jogging.

Sports bras typically either encapsulate or compress breasts. Bras that encapsulate breasts have molded cups, while compression-type bras restrict movement by flattening the breasts against the chest. Encapsulation-type bras generally are more effective at reducing discomfort, but some women prefer compression designs. Most sports bras for large busts encapsulate each breast in order to provide better support. This separation also helps guard against discomfort and irritation that can occur when breasts rub together during a workout. These types of sports bras usually employ underwires and/or thick straps to provide appropriate support. However, underwires can often dig into the wearer's ribs and/or torso amplifying the discomfort during exercise. Additionally, thick straps tend to cause uncomfortable bunching of the wearer's body, causing divots at neck and shoulders, and may limit movement of the wearer. Therefore, it is desirable to have a sports bra that supports the wearer's breasts without the need for an underwire.

SUMMARY

The present invention overcomes the problems and disadvantages associated with current strategies and designs and provides new supportive bras.

Current fashion and structure provides breast support and stabilization by compressing and flattening the breasts to a woman's torso thus widening the breast area to under the arms. The underwire method requires a tight fitting strap from the back strap over the shoulder and clavicle connecting to the cup. This method causes back stress and, over prolonged use, irreversible divots or dents in the clavicle will develop.

The present invention secures the anatomically correct breast placement and provides the necessary support from underneath the breast. Providing support from beneath the breast, the downward trust and shock is reduced, thus reducing the downward pressure and drag on the clavicle.

One embodiment of the invention is directed to a supportive bra. The supportive bra comprises two cups, each adapted to shape, lift, and support a breast, a chest strap coupled to the two cup, and one neck strap coupled to each cup. Each cup has a plurality of darts sewn therein.

Preferably, there are at least four darts sewn into each cup. In a preferred embodiment, each cup is comprised of three layers of fabric. Preferably, the three layers of fabric are a decorative outer layer, a moisture wicking inner layer, and a power mesh middle layer. The outer layer and middle layer are preferably sewn together and the inner layer is sewn separately. Preferably, the supportive bra provides no compressive force.

In a preferred embodiment, the cups are custom fit to a wearer. Preferably, the chest strap is a clear elastic strap. The chest strap is preferably coupled to a clear elastic strap across the back. Preferably, the cups provide support without an underwire or an insert. In a preferred embodiment, the neck straps are adapted to be tied or connected behind a wearer's neck with an adjustable slide and clip.

Another embodiment of the invention is directed to method of customizing a supportive bra. The method comprises the steps of measuring the dimensions of the wearer, selecting at least one cup template based on the dimensions of the wearer, cutting fabric for two cups to match the at least one cup template, sewing the fabric for each cup, wherein the sewing includes sewing darts into the cups, coupling a neck strap to each cup, and coupling a chest strap to the cups.

Preferably at least four darts sewn into each cup. In a preferred embodiment, each cup is comprised of three layers of fabric. The three layers of fabric are preferably a decorative outer layer, a moisture wicking inner layer, and a power mesh middle layer. The method preferably further comprises sewing the outer and middle layers together and sewing the inner layer separately.

In a preferred embodiment, the supportive bra provides no compressive force. Preferably the cups are custom fit to a wearer. Preferably, the chest strap is an elastic strap. The cups preferably provide support without an underwire or an insert. Preferably, the neck straps are adapted to be tied or connected behind a wearer's neck with an adjustable slide and clip. In a preferred embodiment, the measurements include at least one of breast size, breast dimensions, breast weight, nipple position, breast position, and torso dimension.

Other embodiments and advantages of the invention are set forth in part in the description, which follows, and in part, may be obvious from this description, or may be learned from the practice of the invention.

DESCRIPTION OF THE INVENTION

Figure 1:
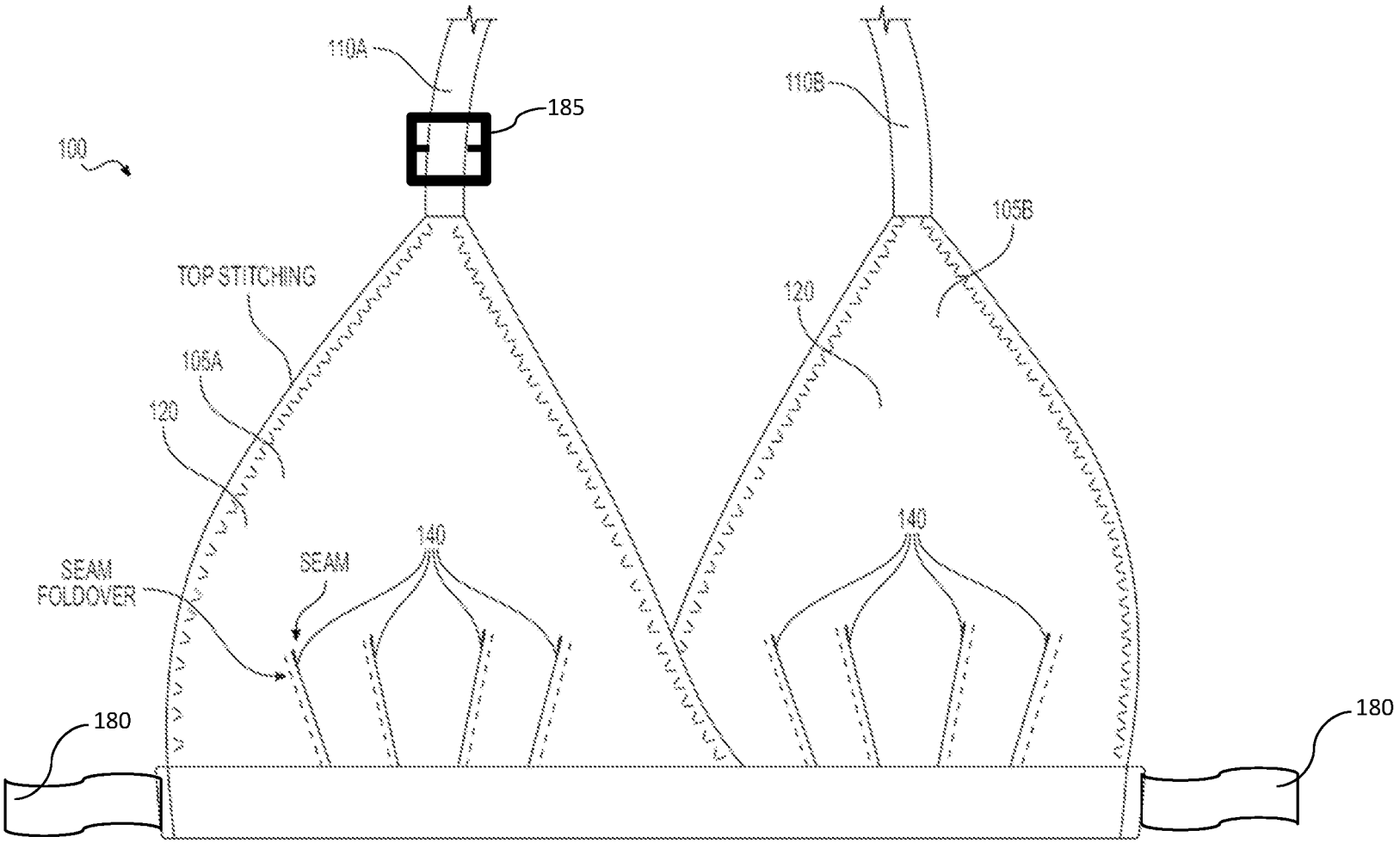
FIG. 1 A front view of an embodiment of a supportive bra.

As embodied and broadly described herein, the disclosures herein provide detailed embodiments of the invention. However, the disclosed embodiments are merely exemplary of the invention that may be embodied in various and alternative forms. Therefore, there is no intent that specific structural and functional details should be limiting, but rather the intention is that they provide a basis for the claims and as a representative basis for teaching one skilled in the art to variously employ the present invention FIG. 1 depicts a front view of supportive bra 100. Supportive bra 100 preferably has two cups 105A and 105B, each one adapted to cover and support a breast, neck straps 110A and 110B extending from each cup 105A and 105B, respectively. Neck straps 110A and 110B preferably are adapted to be tied or otherwise fastened behind the neck of the wearer in a halter configuration. However, in other embodiments neck straps 110A and 110B can be tied in different configurations or can be replaced by other fixation devices (e.g. with an adjustable slide and clip 185). For example, instead of two straps, a single strap may be connected to both cups 105A and 105B, or supportive bra 100 may have a strapless configuration. Additionally, supportive bra 100 also has a chest strap 115. Preferably, chest strap 115 is adapted to be adjustable and fastened on the side torso of the wearer. However, in other embodiments chest strap 115 can be replaced by other fixation devices. For example, instead of an adjustable single strap, chest strap 115 may be a single band of clear material fastened on each side of the torso of the wearer.

Figure 2:
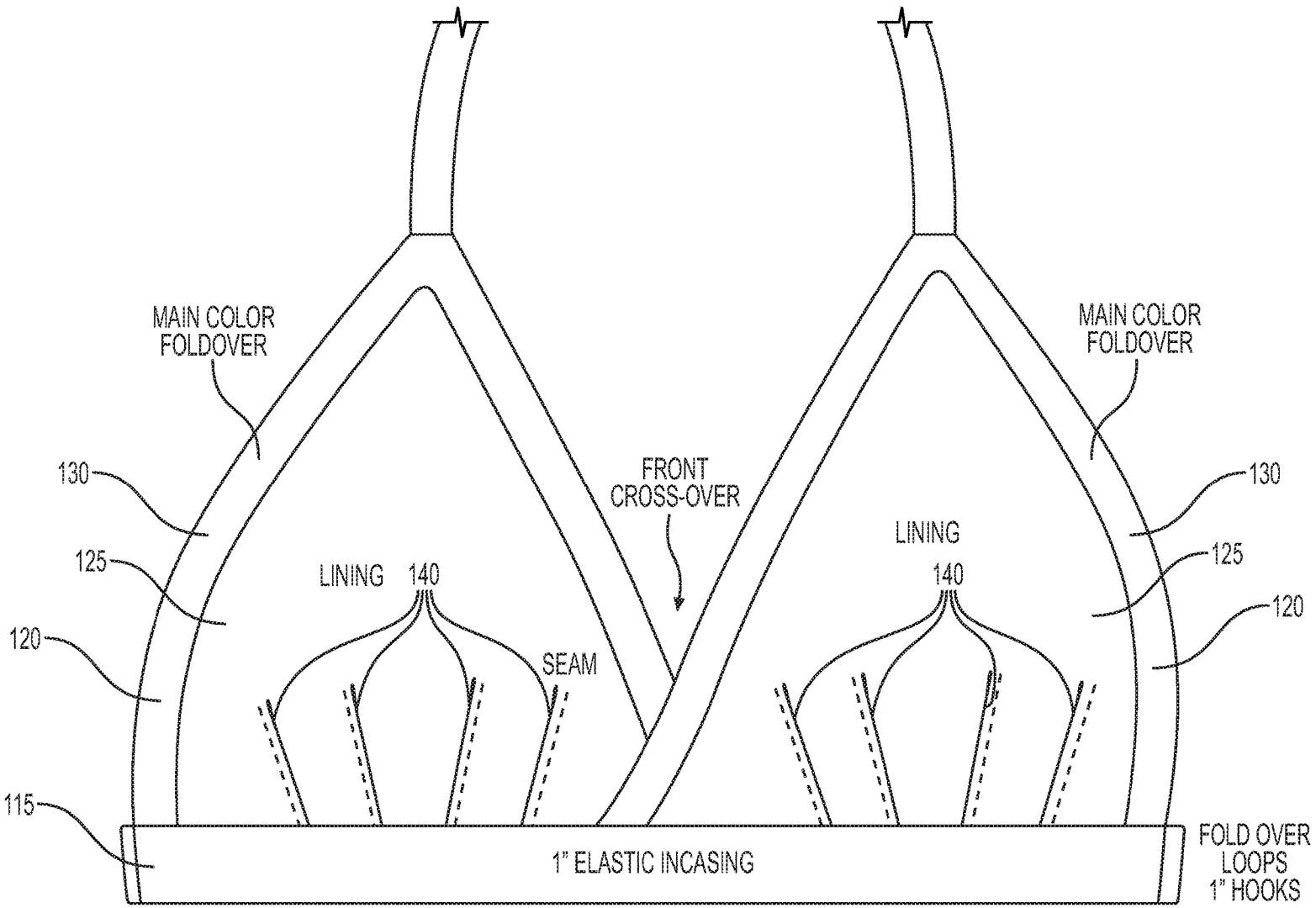
FIG. 2 A back view of an embodiment of a supportive bra.

Preferably, cups 105A and 105B are triangular in shape, however the cups can have other shapes, such as ovular, circular, rectangular, trapezoidal, and combinations thereof. In a strapless configuration, the top triangle cup points are preferably trimmed to an arc to reduce upper the portion of cup coverage, by for example one-third. FIG. 2 depicts an inside view of supportive bra 100. Preferably each cup 105A and 105B has an outer layer 120 and an inner layer 125. Outer layer 120 is preferably a decorative fabric having, for example, a pattern, one or more colors, a picture, a texture, words, two- or three-dimensional objects, another embellishment, or combinations thereof. Inner layer or lining 125, is preferably a moisture wicking and/or absorbent material. Each of outer layer 120 and/or inner layer 125 may be stretchable or unstretchable. Each of outer layer 120 and/or inner layer 125 may be made of cotton, nylon, polyester, spandex, silk, wool, lace, leather, neoprene, other fabrics made of naturally occurring or manmade fibers, or combinations thereof. In a preferred embodiment, the upper edges of outer layer 120 are folded over inner layer 125 and sewn together to make hem 130. In other embodiments, inner layer 125 is folded over outer layer 120, the edges are sewn together without folding, or another piece of material is folded over both layers and sewn together. A strip of elastic may be sewn into the hem 130.

In a preferred embodiment, chest strap 115 is a strip of elastic, (preferably no-roll elastic) surrounded by fabric. The fabric is preferably the same material as inner layer 125, however, the fabric may be another material. Chest strap 115 is preferably up to two inches thick, more preferably, between ½ and 1.5 inches thick, and more preferably one inch thick. In a preferred embodiment, neck straps 110A and 110B are strips of fabric folded over and sewn into a strap. The fabric is preferably the same material as inner layer 125, however, the fabric may be another material.

Figure 3:
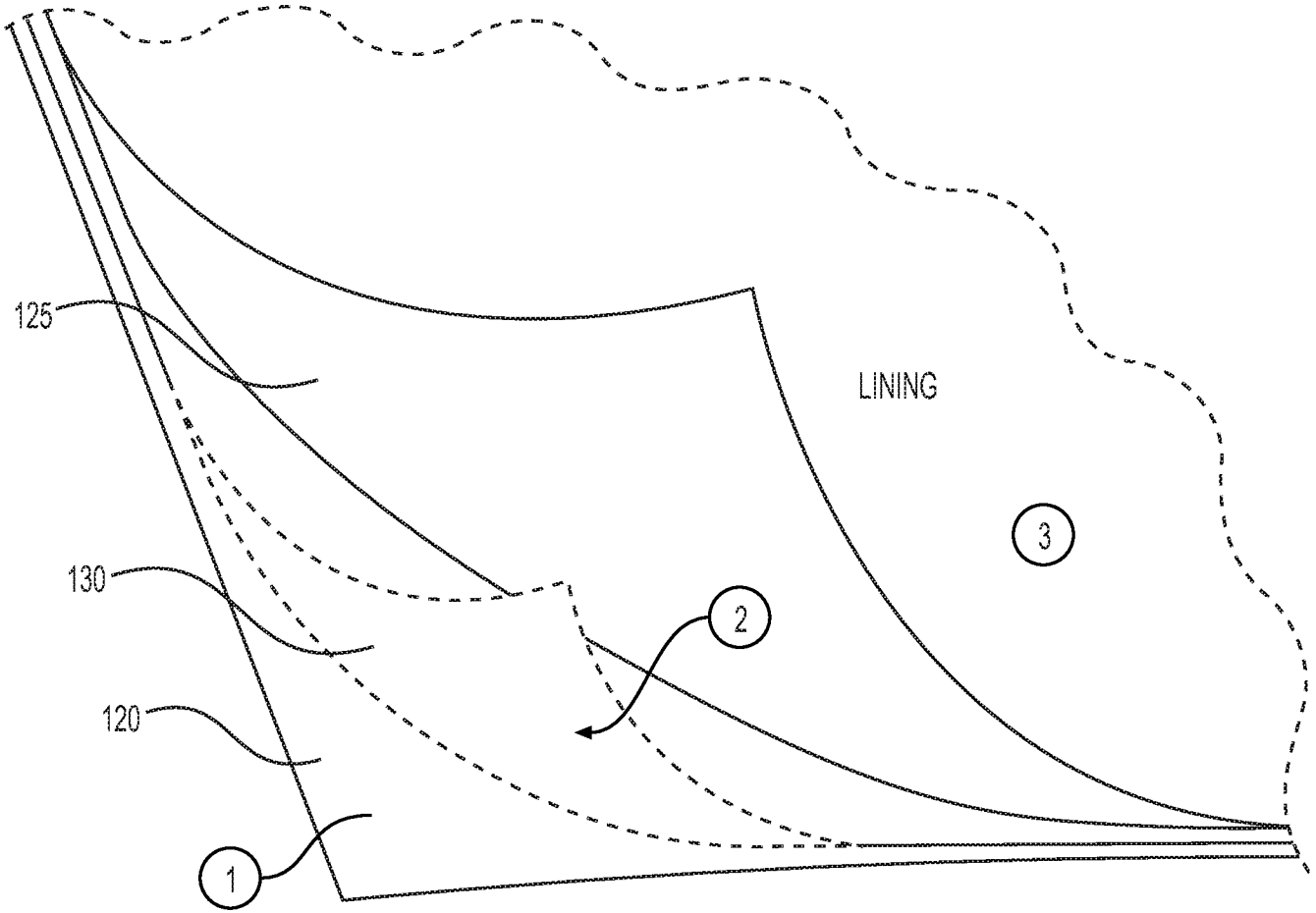
FIG. 3 An exploded view of the layers of an embodiment of a supportive bra.

FIG. 3 depicts an exploded view of the layers of cups 105A and 105B of supportive bra 100. Preferably each cup 105A and 105B has three layers as follows: (1) outer layer 120 (as described herein), (2) middle layer 130, and (3) inner layer 125 (as described herein). Middle layer 130 is preferably a power mesh fabric. For example, the power mesh fabric may be a four-way stretchable yet sturdy fabric. The power mesh fabric is preferably a blend of polyester and spandex. Middle layer 130 preferably provides structure to cups 105A and 105B and supports the breasts without a compressive force.

As can be seen in FIGS. 1 and 2, each cup 105A and 105B has a plurality of darts 140 extending from the bottom edge into the body of the cup. While each cup is shown having four darts 140, the cups may have more or fewer darts. The number of darts may depend on the size of the cups and/or on the size of the wearer's torso. For example, wearer's with larger cups and/or larger torsos may have more darts in the cups while wearer's with smaller cups and/or smaller torsos may have fewer darts in the cups. Supportive bra 100 may be custom fit for each wearer and/or supportive bra 100 may come in a variety in standard or non-standard sizes to fit multiple people. Preferably, darts 140 provide additional support and structure to each cup 105A and 105B. Darts 140 increase the rigidity of the fabrics of each cup 105A and 105B without the need for an underwire or other insert. Additionally, synthetic boning strips may be added to the darts 140, for example on inner layer 125

Figure 4:
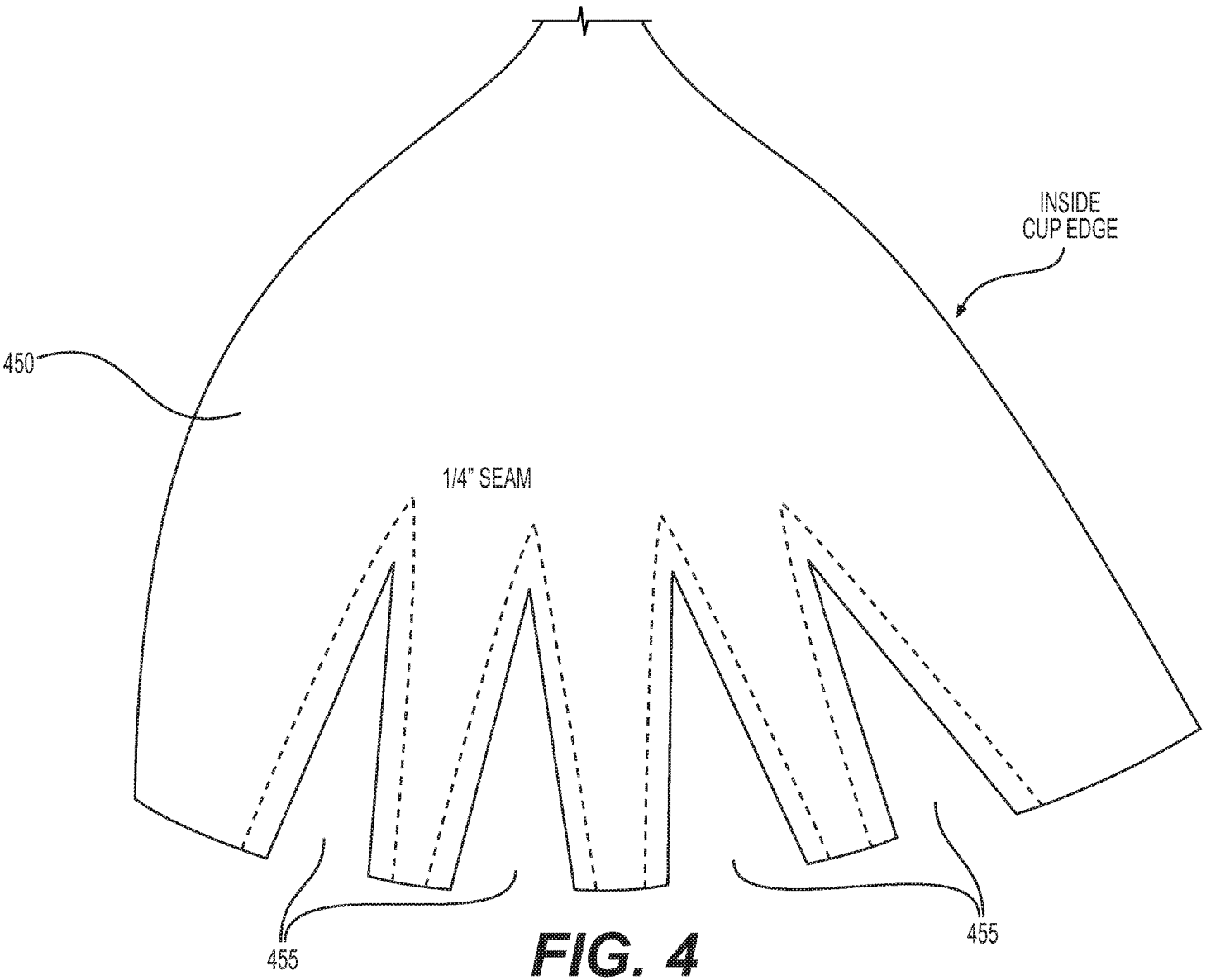
FIG. 4 An embodiment of a cup template.

FIG. 4 depicts a template 450 for cutting the materials of cups 105A and 105B. Template 450 may be reduced or increased in size to accommodate the proper size of cups 105A and 105B. Preferably, template 450 has cutouts 455. During assembly, when the edges of each cutout 455 are sewn together, they create darts 140. Such sewing also gives cups 105A and 105B a curved shape. The depth, width, and number of cutouts 455 may be changed to adjust the curvature, amount of support, and size of cups 105A and 105B.

Figure 5:
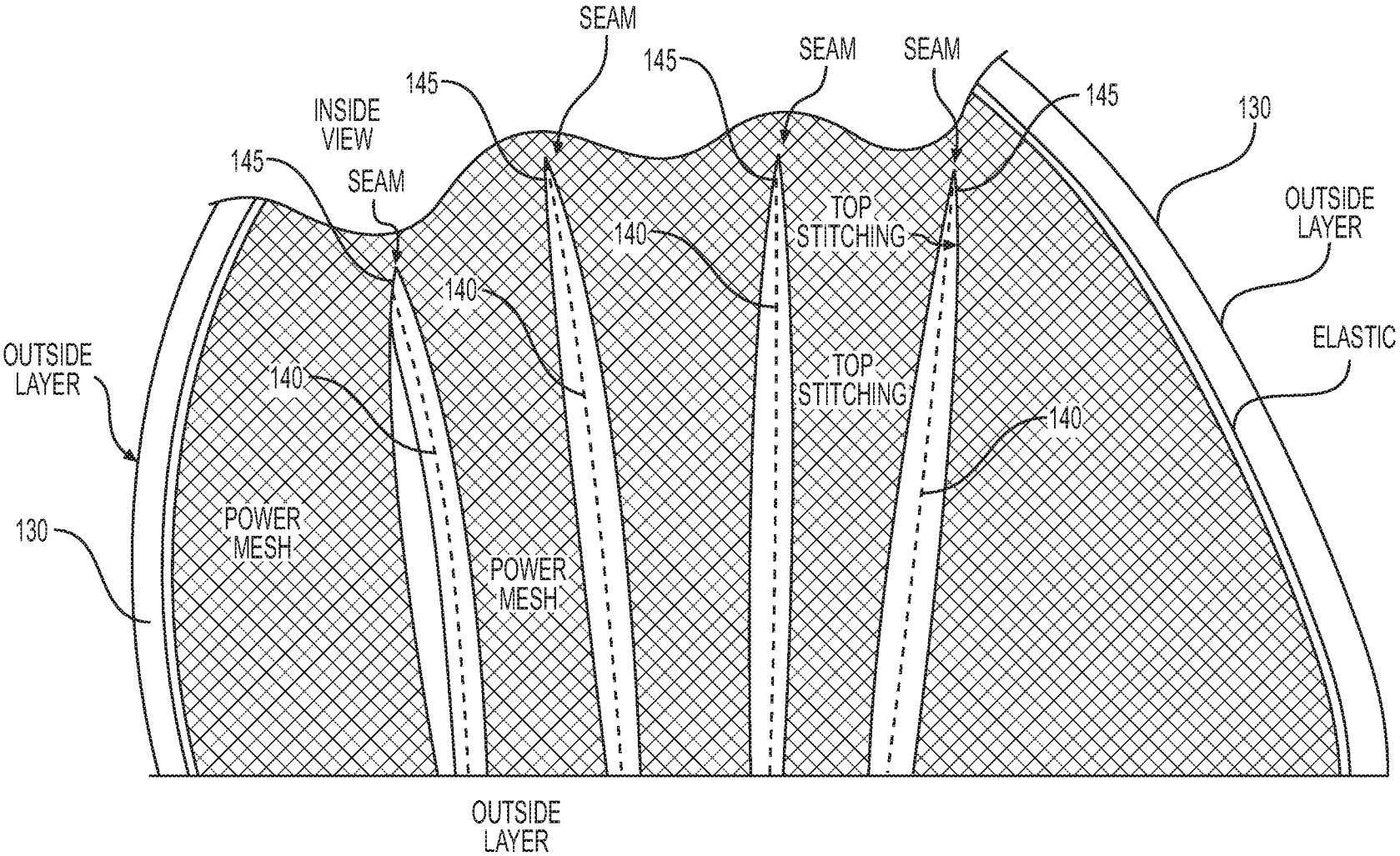
FIG. 5 A view of an assembled cup.

FIG. 5 depicts an embodiment of a cup sewn together. Preferably, outer layer 120 and middle layer 130 are sewn together and inner layer 125 is sewn separately and then coupled to the outer and middle layers at the edges. However, in other embodiments, inner layer 125 and middle layer 130 are sewn together and outer layer 120 is sewn separately and then coupled to the inner and middle layers at the edges, or all three layers are sewn together or separately. While all three layers are shown as having darts 140, in some embodiments certain layers may not have darts 140. Preferably, the darts 140 are sewn together such that the seam 145 is folded over and then a top stitching is applied.

Another embodiment of the device is directed to a breast shaping, lifting, support and display garment intended to be worn under other garments or more preferably without other garments, as a workout sports bra or bikini top garment or lingerie garment. The device preferably acts as a bra or sports bra, performing the same functions of support, lift, and shaping as a bra or sports bra but with the added element of allowing the wearer to display their individual breast shape, volume, and overall musculature and skin tone, in the context of the wearer's entire upper body physique. The garment preferably comprises right and left fabric panel cups with support darts for overlying and under-lifting the wearer's right and left breasts, straps over the shoulders or, in some versions, around the neck as a halter top, and a connected support band around the wearer's torso that is preferably made of transparent moderately flexible material in the rear of the garment when worn. The right and left panel cups preferably have a relatively flattened configuration when not worn, and the straps and support band are also preferably flat in configuration. When worn, due to the darts, the garment preferably shapes, lifts, supports, and displays the wearer's breasts in the panel cups over the support band without relying on the straps over the shoulders or around the neck. Preferably, the straps then are available for design for decorative and other purposes. The panel cups include four (4) or more darts of length and spacing specific to the individual measurements of the wearer's breasts, including their nipple placement, and are preferably sewn/integrated into the support band in a way that allows for the breasts (from A up to K cup or higher) to be lifted up and out, with or without additional padding. The padding may be integrated into the garment in a pocket sewn into the panel cups. The darts in the fabric of the panel cups and the support band is preferably sufficient for the garment to lift, support, shape, and display the breast in a way that is comfortable and secure without the breast being exposed or falling out during weight-lifting and other vigorous exercise, flexing, posing, dancing, performing yoga, other movement, or at rest. The fabric is preferably a multi-way stretch lycra blend or similar in nature, but may also include leather, rubber, plastic or other natural or synthetic materials with sufficient multi-way stretch characteristics. The rear of the garment 180 is preferably transparent (see-through) and of elastic capacity on the back of the torso that does not detract or take away from the overall support, lifting, shaping, and display qualities of the garment when worn. The rear of the garment also preferably provides a second skin level of flexibility while preserving the security that minimizes slippage.

The garment preferably is adapted to shape, lift, support, and display the wearer's breasts with comfort and security, without relying on straps over the shoulders or around the wearer's neck (as a halter would, for example). This is preferably provided by the placement and length of the darts above the band, working synergistically with the width of the band and the panel over each breast in a symmetrical manner. This system preferably depends on accurately understanding both of the wearer's breast in three (3) dimensions, in addition to an approximation of the mass or weight or each breast, especially if the breast includes artificial breast implants. The garment uses a system of key measurements that comprise an algorithm (series of steps in proper order) that includes the following for each breast:

(A) Measure along the surface of the skin in a straight horizontal line from center of the sternum/breastbone across left nipple to rib on the outer side of the breast.

(B) Measure along the surface of the skin in a straight vertical line from a spot approximately three (3) inches below the collarbone directly above the nipple and then across the nipple to the underside of the breast where it connects to the ribcage.

(C) Measure along the surface of the skin in a straight horizontal line from the sternum/breastbone along the bottom underside crease of the breast well below the nipple along the ribcage to the far side of the ribcage.

Through the synergy of the system's steps of breast measurement as described above, coupled with proper number and placement of the darts in the proper length, with appropriately wide (but not too wide) band with integrated see-through back to the band, the garment preferably delivers comfort, security, shaping, support, and the desired display qualities for the wearer in both front and back.

Other embodiments and uses of the invention will be apparent to those skilled in the art from consideration of the specification and practice of the invention disclosed herein. All references cited herein, including all publications, U.S. and foreign patents and patent applications, are specifically and entirely incorporated by reference. The term comprising, wherever used, is intended to include the terms consisting and consisting essentially of. Furthermore, the terms comprising, including, and containing are not intended to be limiting. It is intended that the specification and examples be considered exemplary only with the true scope and spirit of the invention indicated by the following claims.

The invention claimed is:

1. A supportive bra, comprising:

two substantially triangular cups; and a chest strap coupled to the two cups;

wherein the supportive bra is not compressive and has no underwire or inserts;

wherein each cup comprises:

a bottom edge coupled to the chest strap, an outside edge, and an inside edge;

a plurality of darts sewn therein, each dart extending from the bottom edge into each cup;

three layers of fabric consisting of a decorative outer layer, a moisture wicking inner layer, and a power mesh middle layer; and a hem coupling the three layers of fabric together at the outside and inside edges, wherein the hem includes a strip of elastic material sewn into the hem;

wherein only the cups, the plurality of darts in each cup, the hems, and the chest strap provide shape, lift, and support to a user's breasts.

2. The supportive bra of claim 1, wherein the plurality of darts includes at least four darts sewn into each cup.

3. The supportive bra of claim 1, wherein the outer layer and the middle layer are sewn together and the inner layer is formed separately and then coupled to the outer and middle layers.

4. The supportive bra of claim 1, wherein the supportive bra is a sports bra.

5. The supportive bra of claim 1, wherein the cups are custom fit to a wearer.

6. The supportive bra of claim 1, wherein the chest strap is an elastic strap.

7. The supportive bra of claim 6, wherein the chest strap is coupled to a clear elastic strap across a back of the supportive bra.

8. The supportive bra of claim 1, further comprising neck straps, wherein the neck straps are adapted to be tied or connected behind a wearer's neck with an adjustable slide and clip.

9. The supportive bra of claim 8, wherein the neck straps are decorative and do not provide support to the breasts.

10. The supportive bra of claim 1, wherein at least one of the number of darts and a length of each dart depends on at least one of the user's cup size and torso dimensions.

11. The supportive bra of claim 1, wherein a width of the chest strap depends on at least one of the user's cup size and torso dimensions.

12. The supportive bra of claim 1, wherein each cup is adapted to under-lift a breast.

* * * * *